US006481771B1

(12) United States Patent
Friedman

(10) Patent No.: US 6,481,771 B1
(45) Date of Patent: Nov. 19, 2002

(54) DISPOSABLE HANDLE FOR CARRYING PLASTIC SHOPPING BAGS AND THE LIKE

(76) Inventor: Linda Friedman, 190 Kelly Blvd., Staten Island, NY (US) 10314

( * ) Notice: Subject to any disclaimer, the term of this patent is extended or adjusted under 35 U.S.C. 154(b) by 0 days.

(21) Appl. No.: 09/974,614

(22) Filed: Oct. 6, 2001

(51) Int. Cl.[7] ..... A45F 5/10; B65D 33/06

(52) U.S. Cl. ..... 294/171; 294/149

(58) Field of Search ..... 294/137, 141, 294/149, 153, 158, 165, 166, 170, 171; 16/406, 422, 425, 428; 24/16 PB, 17 A, 17 AP, 30.5 R, 30.5 P; 383/6, 13, 25; D9/434, 455

(56) References Cited

U.S. PATENT DOCUMENTS

| | | | | | |
|---|---|---|---|---|---|
| 2,215,116 | A | * | 9/1940 | Crary | 294/171 |
| 3,672,003 | A | * | 6/1972 | Morgan | 24/16 PB |
| D227,660 | S | * | 7/1973 | Konno | 294/171 X |
| 4,071,063 | A | * | 1/1978 | Russell | 294/171 X |
| 4,262,385 | A | * | 4/1981 | Norman | 294/171 X |
| 4,796,940 | A | * | 1/1989 | Rimland | 294/171 |
| 4,902,060 | A | * | 2/1990 | Nobakht | 294/171 |
| 5,005,891 | A | * | 4/1991 | Lunsford | 294/171 |
| 5,738,401 | A | * | 4/1998 | Fan | 294/171 |
| 6,062,622 | A | * | 5/2000 | Susman et al. | 294/149 |
| 6,234,946 | B1 | * | 5/2001 | Fricano | 294/171 X |
| 6,354,645 | B2 | * | 3/2002 | Bozlee | 294/171 |

FOREIGN PATENT DOCUMENTS

| | | | | |
|---|---|---|---|---|
| GB | 2246285 | * | 1/1992 | 294/171 |

* cited by examiner

*Primary Examiner*—Johnny D. Cherry
(74) *Attorney, Agent, or Firm*—Goldstein & Lavas, P.C.

(57) ABSTRACT

A handle, for supporting and carrying shopping bags, comprising a continuous piece of material having a first end, a second end, an outer side, and an inner side. A tab extends from the first end, and a slot is located at the second end. The handle is bent, creating a pair of symmetrical broad surfaces for the user to hold and a valley region extending longitudinally therebetween. The bags extend longitudinally within the valley region. The bags are selectively secured within the handle by locking the first end and second end by inserting the tab into the slot.

10 Claims, 6 Drawing Sheets

DISPOSABLE HANDLE FOR CARRYING PLASTIC SHOPPING BAGS AND THE LIKE

BACKGROUND OF THE INVENTION

The invention relates to a disposable handle. More particularly, the invention relates to a device which accepts the handle openings from a plurality of shopping bags, and then provides a broad comfortable surface for the user to simultaneously support all of said shopping bags.

When exiting a store after a purchase, consumers often find themselves carrying one or more shopping bags. In recent years, the plastic shopping bag has all but replaced the traditional, rope-handled paper shopping bag. The plastic shopping bag is made of a thin plastic film. The plastic shopping bag mimics the traditional bag by providing two hand openings, which are generally stamped out during manufacture.

To carry the plastic shopping bag, the consumer places one hand through both hand openings, and the entire weight of the bag thereby becomes supported by the hand. The problem with holding plastic shopping bags in this manner, is that the thin film nature of the shopping bag minimizes the surface area on the hand upon which all of the weight of the bag is distributed. As the bag gets heavier, the handles have a tendency to stretch out and gather into a compact bunch. This bunch feels more like a wire, and painfully cuts into the hand. The discomfort is multiplied when carrying multiple shopping bags—such as when exiting a supermarket.

In recent years, people have proposed stand-alone handles which seek to support multiple shopping bags, and provide the consumer with a more comfortable handle. These designs are generally complex, and as such, are expensive. Thus, they require an up-front purchase by the consumer—who is then forced to bring the handle along on any shopping trip. In addition, they are generally open-ended, allowing the shopping bags and their contents to slip out at inopportune times.

While these units may be suitable for the particular purpose employed, or for general use, they would not be as suitable for the purposes of the present invention as disclosed hereafter.

SUMMARY OF THE INVENTION

It is an object of the invention to provide a handle which allows several shopping bags to be comfortably carried. Accordingly, the bag supports numerous shopping bags and provides a broad, comfortable surface by which the consumer, in turn, supports the handle.

It is another object of the invention to produce a handle which may be inexpensively manufactured, so that it is disposable and readily available to consumers. Accordingly, the handle is a single piece construction, which may be stamped from a single piece of material at a very low cost.

It is yet another object of the invention to provide a handle which is disposable, and which may be used as a promotional item bearing an advertisement. Accordingly, the low manufacturing cost allows the handle to serve as a promotional "give-away", wherein advertising revenue from the advertisement can easily cover the manufacturing cost of the handle, thus allowing the handle to be disposable.

It is a further object of the invention to provide a handle which allows multiple bags to be carried securely, without risking loss of their contents. Accordingly, the handle has a locking mechanism which selectively opens to allow shopping bag handles to be inserted and removed, and selectively closes to securely maintain the shopping bag handles therein.

The invention is a handle, for supporting and carrying shopping bags, comprising a continuous piece of material having a first end, a second end, an outer side, and an inner side. A tab extends from the first end, and a slot is located at the second end. The handle is bent, creating a pair of symmetrical broad surfaces for the user to hold and a valley region extending longitudinally therebetween. The bags extend longitudinally within the valley region. The bags are selectively se-cured within the handle by locking the first end and second end by inserting the tab into the slot.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
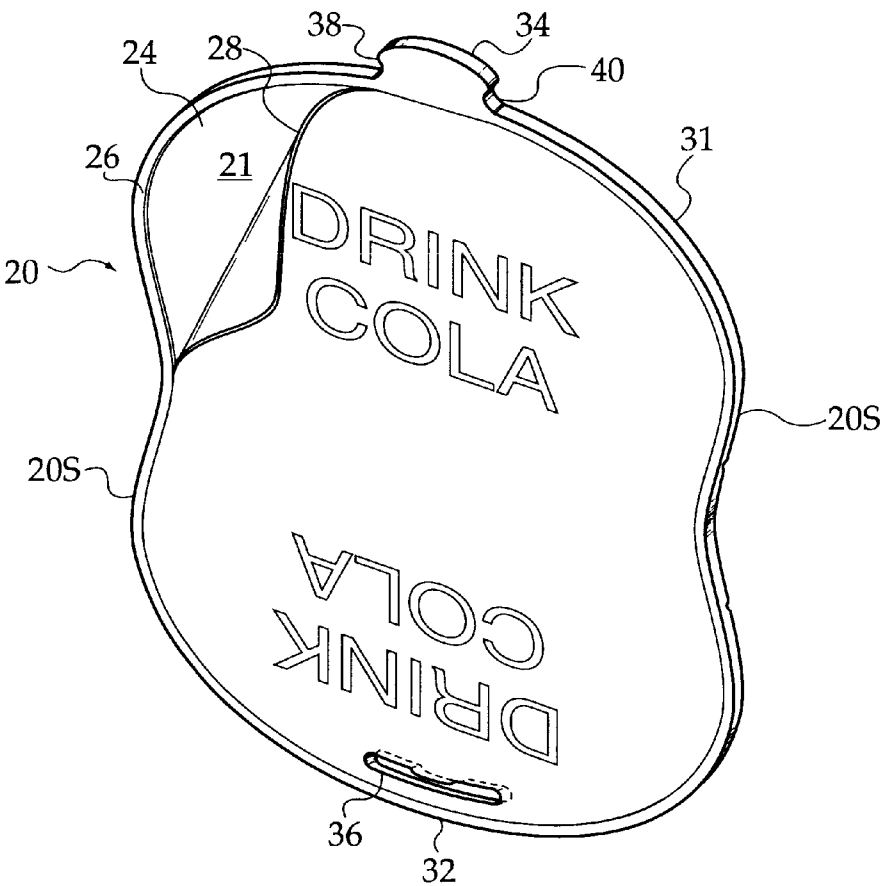
FIG. 1 is a perspective view, illustrating an outer side of a first embodiment of the present invention, laid substantially flat, wherein an advertisement is being adhered thereto.
Figure 13:
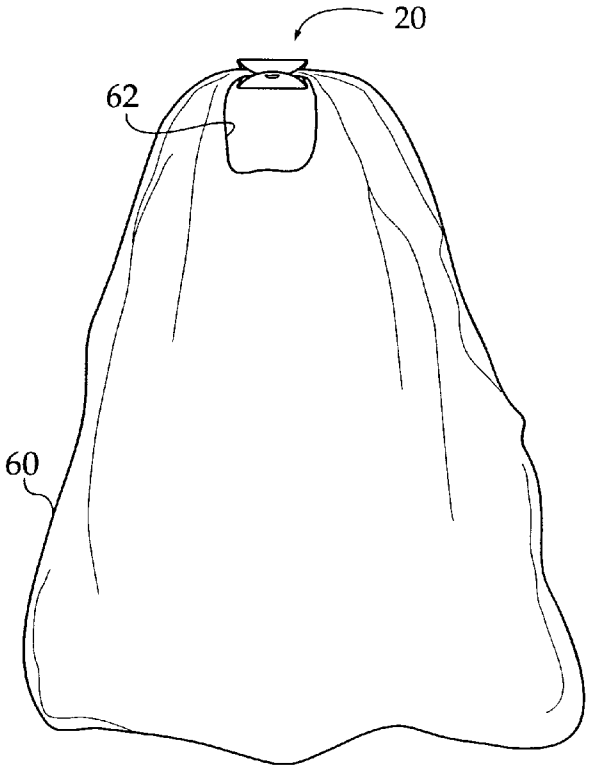
FIG. 13 is a side elevational view, wherein the handle has been inserted through the handle cutout of a shopping bag, and then has been closed to allow the shopping bag to be supported and carried by the present invention.

FIG 1 illustrates a handle 20 for carrying shopping bags, by supporting the shopping bag handles thereof. Referring momentarily to FIG. 13, shopping bags 60 of the type illustrated are typically constructed of thin plastic film, are designed to support a significant weight and house a significant volume of merchandise, and generally have a pair of handle cutouts 62, which define an opening through which a user generally supports the shopping bag 60 with one hand. More traditional shopping bags often have rope shopping bag handles which define the opening through which the user generally supports the shopping bag 60 with one hand. In addition, paint cans have wire handles which create such openings and can be supported in a similar manner. As seen in FIG. 13, the handle 20 is in a rolled, operative position, is engaged with the handle cutouts 62 of the shopping bag 60, and is ready for use in carrying said shopping bag 60.

With regard to the present discussion, inasmuch as there exists a large potential for confusion between the "handle" of the present invention and "handles" of the shopping bags which are supported by said handle, every attempt is made herein to be clear about which "handle" is being referred to. In general, "the handle" refers to the present invention, and "handle cutouts" or "shopping bag handle", refers to those preexisting devices which are supported by the present invention.

FIG. 1 illustrates the handle 20 according to the present invention substantially laid flat, as it would typically be following manufacture. An outer side 21 of the handle 20 is illustrated. The handle 20 has been formed from a single piece of continuous sheet-like material, which may be plastic, such as low cost, recycled polyethylene or polypropylene, or any other flexible material, such as various types of cardboard, including clapboard or chipboard. It preferably has a thickness of at least 0.040 inches, and is substantially flat, other than a few topographical features created during stamping. In particular, a recessed center section 24 is created on the outer side 21 within a border 26 to accommodate a printed advertisement insert 28. The advertisement insert 28 may bear any logo, indicia, or message desired. In addition, such indicia or advertisement message can also be silk-screened directly to the handle.

Figure 3:
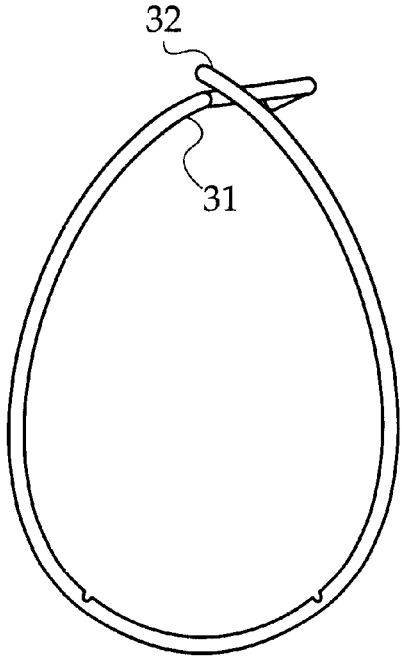
FIG. 3 is a side elevational view, illustrating the handle rolled into its operative position, wherein the first end and second end are locked together.
Figure 4:
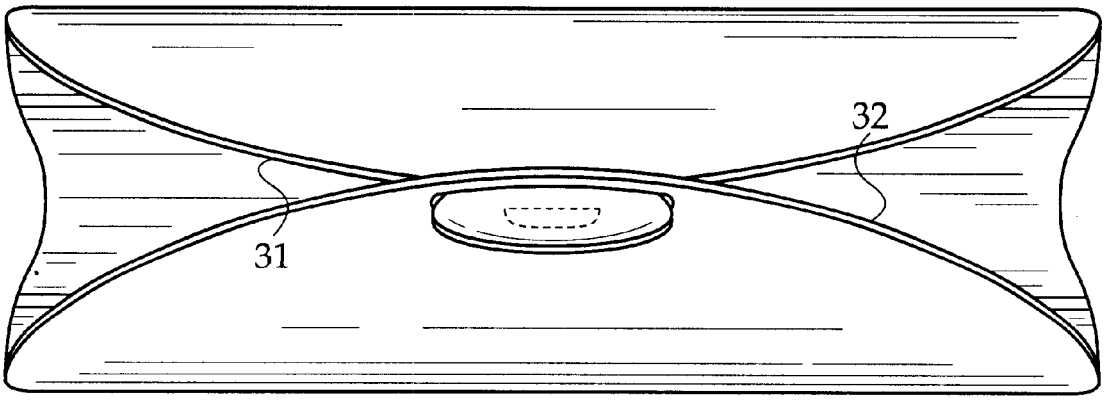
FIG. 4 is a top plan view of the handle in the operative position.
Figure 5:
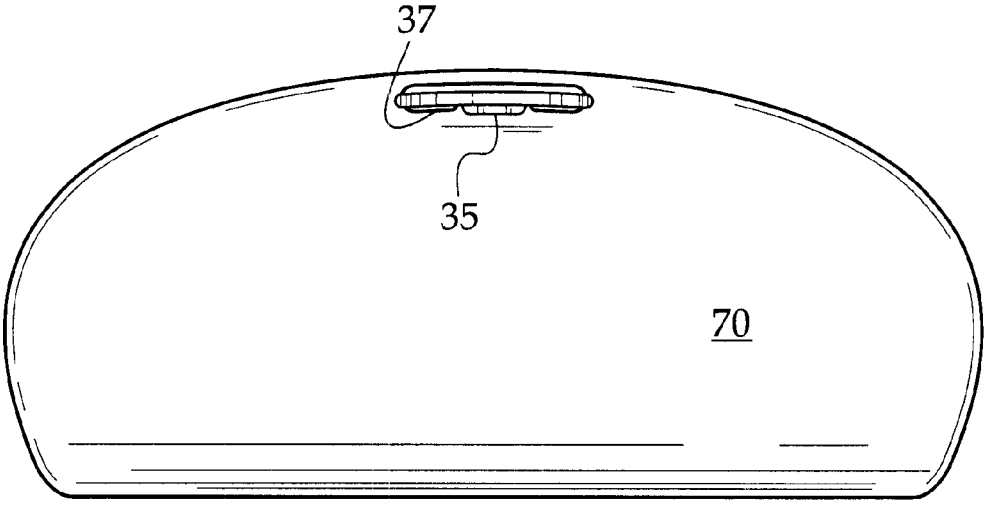
FIG. 5 is a side elevational view of the handle of FIG. 4, detailing the interaction between the tab and slot, and details thereof.

The handle 20 has a first end 31, a second end 32, and a pair of sides 20S. A locking closure includes a tab 34 at the first end 31 and a slot 36 at the second end 32. The tab 34 and slot 36 are correlated so that they can be selectively engaged to join the first end 31 and second end 32 as seen in FIG. 3, and selectively disengaged. In particular, the slot 36 is substantially oval shaped, having a slot width on its major axis, and a slot height on its minor axis. The tab 34 has a flange 38 and a neck 40, such that the tab 34 adjoins the first end 31 at the neck 40. Further, the flange 38 has a flange width which is slightly larger than the slot width. Accordingly, when the tab 34 is inserted into the slot 36, the material surrounding the slot and/or the tab 34 deform slightly until the tab "snaps" through, and then becomes caught in the slot, as seen in FIG. 4. In addition, a tab bump 35 is provided on the tab 34 on the inner side 22, and the slot 36 has a protrusion 37 which acts to narrow the slot to resist passing the tab bump 35 therethrough. The tab bump 35 extends laterally from the otherwise substantially flat tab 34, and represents a regional "thickening" of the tab. When the tab 34 is inserted into the slot 36, the tab bump 35 squeezes past the protrusion 37, and then becomes caught therebehind, further strengthening the locking closure. FIG. 5 illustrates the closure, wherein the bump 35 is trapped behind the protrusion 37, which visually is partially blocked by the bump 35 in this illustration. Along with the flange 38, the bump 35 helps keep the closure locked, maintaining the connection between the first end 31 and second end 32.

Figure 2:
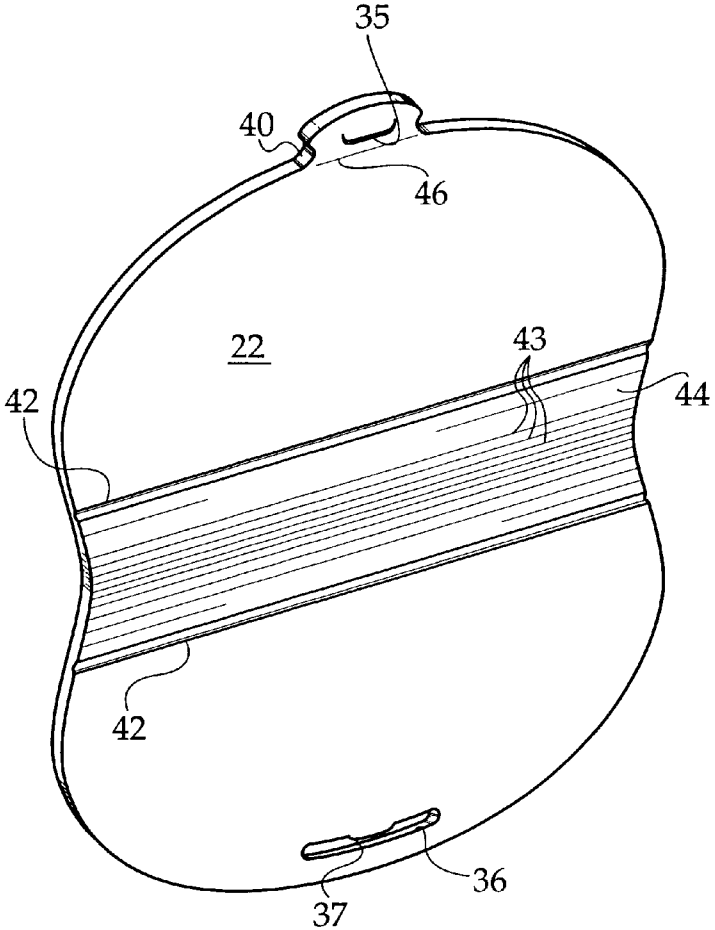
FIG. 2 is a perspective view, illustrating an inner side of the invention, laid substantially flat.
Figure 11:
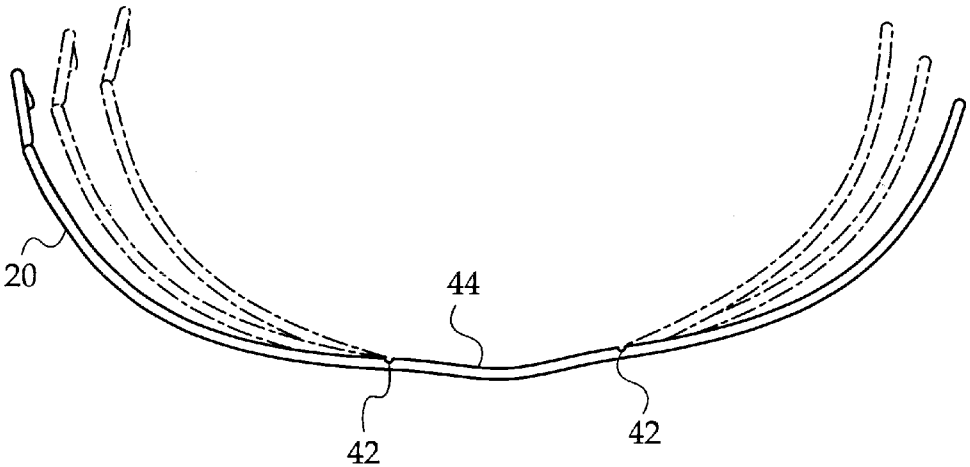
FIG. 11 is a side elevational view, illustrating how the invention is folded from a substantially flat position from manufacture, to a rolled position for use.

FIG 2 illustrates an inner side 22 of the handle 20. Since the handle 20 must be bent, folded, or "rolled" into the position shown in FIG. 3 and FIG. 4, provisions should be made to facilitate the bend where desired, to resist breakage, undesirable deformation, and undue springiness or resistance to remaining in the rolled position. Accordingly, a pair of longitudinal score lines 42 may be used to define a valley region 44. Illustrated in FIG. 11, when the handle 20 is rolled, the valley region 44 forms a region where the shopping bags are supported. The longitudinal score lines 42 help ensure that the valley region 44 is easily formed, and the handle 20 in fact bends easily when rolled. Additional fine score lines 43 may be provided between and parallel to the longitudinal score lines 42 to further facilitate bending of the handle 20. A tab crease 46 may be provided at the neck 40 to facilitate bending of the tab 34 to effect closure.

In addition, it can be seen from FIG. 1 and FIG. 2, that the overall footprint of the handle 20 is loosely circular, except that the curvature thereof tightens and reverses on the sides 20S of the handle, such that the sides 20S are substantially parallel centrally within the valley region 44. This allows the shopping bags to hang properly when the handle 20 is rolled and the valley region 44 then forms a lowermost portion of said handle 20.

Figure 8:
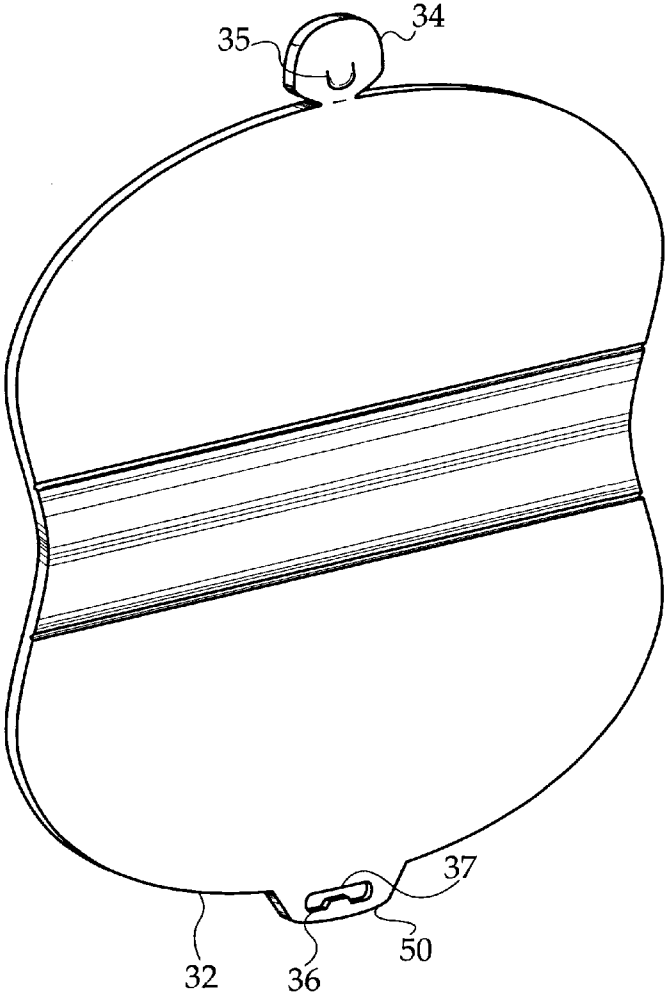
FIG. 8 is a perspective view of the inner side of the second embodiment of the invention.
Figure 9:
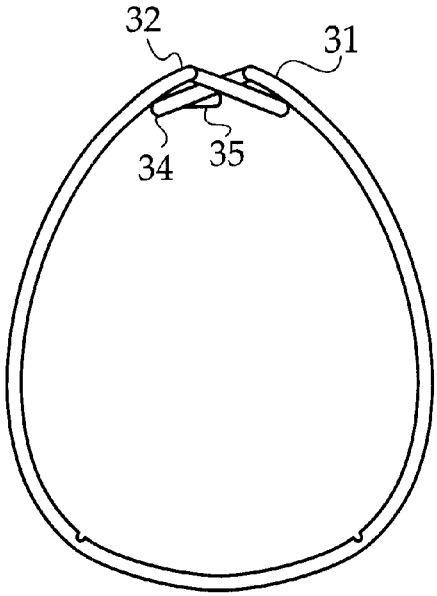
FIG. 9 is a side elevational view thereof in the operative position, illustrating an alternate locking closure in use connecting the first and second end.
Figure 10:
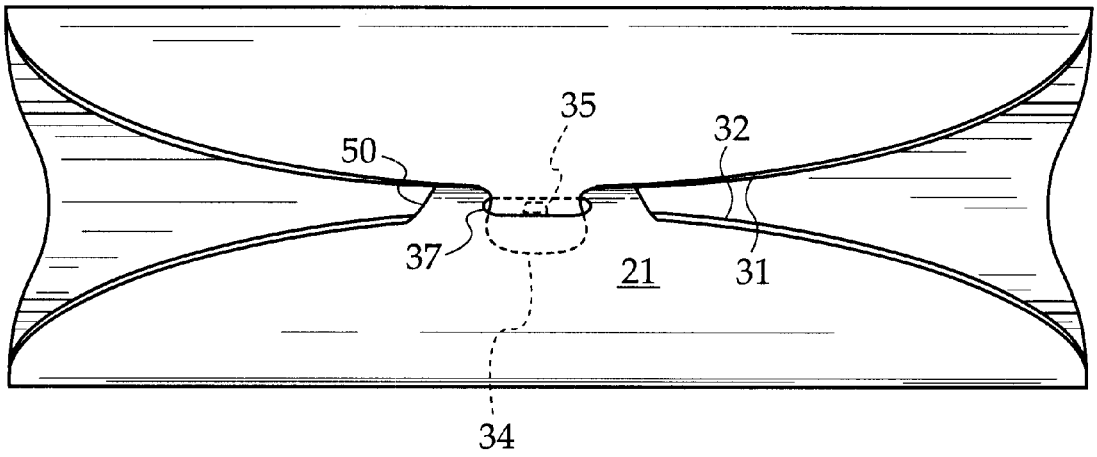
FIG. 10 is a top plan view thereof, illustrating the closure.

In the embodiment of FIG. 1–6, the tab 34 enters the slot 36 from the inner side 22, as best seen in FIG. 3. However, in a second embodiment, shown in FIG. 7–10, certain adaptations are made to the tab 34 and first end 31 near the tab so that the tab 34 enters the slot 36 from the outer side 21, extends beyond the inner side 22, and the neck becomes trapped at the slot 36, as best seen in FIG. 9. In particular,a slot extension 50 extends from the second end 32, wherein the slot 36 is located in the slot extension 50. Referring to FIG. 7 and FIG. 8, the protrusion 37 is located on the slot on a side of the slot which is more distant from the tab 34 when the handle 20 is laid flat. This allows the tab to be inserted from the outer side 21 as seen in FIG. 10, and still have the tab bump 35 engage the protrusion. However, noting FIG. 2, for the first embodiment, the protrusion 37 is on a side of the slot which is nearest to the tab 34 when the handle is laid flat.

Figure 6:
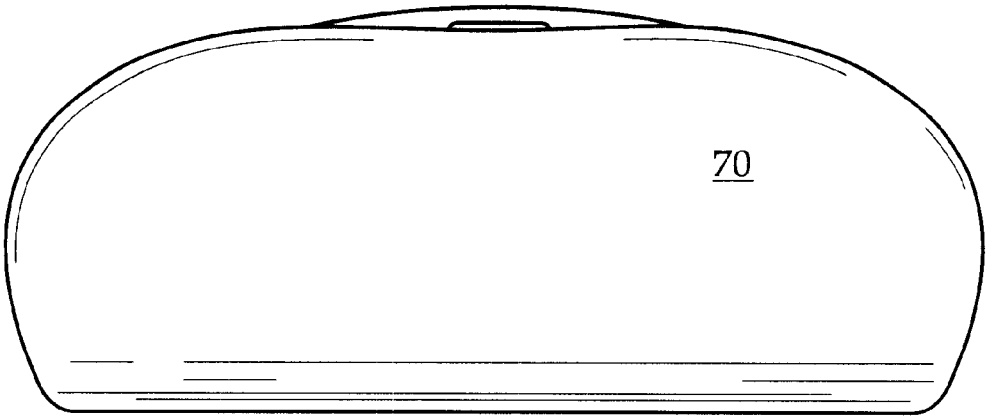
FIG. 6 is a side elevational view, similar to FIG. 5, except from an opposite side thereof.
Figure 7:
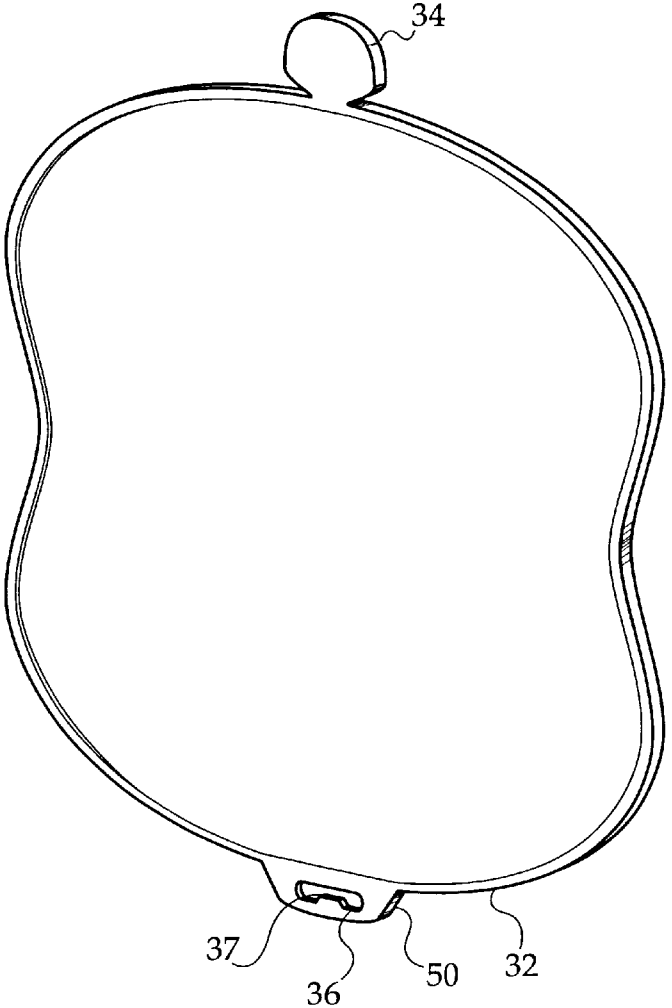
FIG. 7 is a perspective view of the outer side of a second embodiment of the invention.
Figure 12:
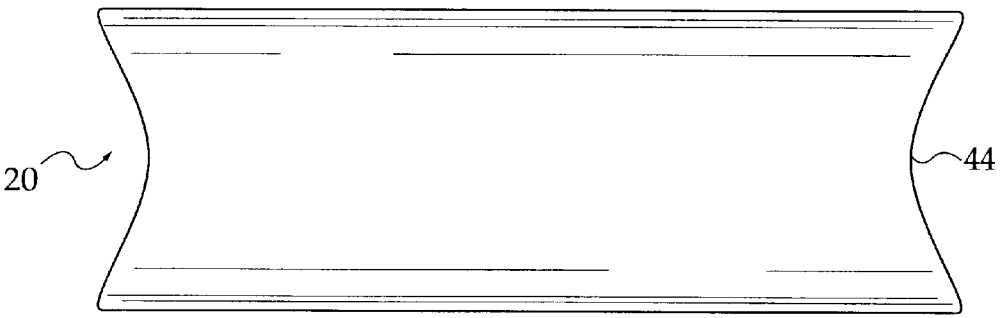
FIG. 12 is a bottom plan view, illustrating how the side indentures provide an accommodation for gathered shopping bag handle cutouts.

FIG. 6 and FIG. 10 illustrate that when the handle 20 is in its operative, rolled position, it provides a significant surface area to grasp. The overall substantially circular shape of the handle, when laid flat, causes it to create a "taco" shape when in the rolled, operative position, wherein the inner side is concave and the outer side is convex. When in the operative position, it provides two opposed broad surfaces 70 that are substantially symmetrical about the valley region. The broad surfaces 70 have substantial surface area, which is easily grasped by the user. In addition, the shopping bags extend longitudinally along the valley region, the bottom of which is seen in FIG. 12, such that the shopping bags are logically supported at a lowermost point of the handle 20 point of the handle 20.

In conclusion, herein is presented a handle, for allowing a consumer to carry numerous shopping bags, wherein the handle is used to engage, capture, and support all of said bags, while the user holds the handle, which provides a broad surface area to hold. This invention is illustrated by example in the accompanying drawing figures and in the foregoing description. Numerous variations are possible, while adhering to the inventive concept. Such variations are contemplated as being a part of the present invention.

What is claimed is:

1. A handle, for supporting shopping bags, comprising:

a substantially flat piece of material, having an outer side, an inner side, a first end, a second end, and a pair of sides extending between the first end and second end, the material bendable to selectively bring the first end and second end together;

a slot extension, extending from the second end, the slot extension having a slot;

a tab extending from the first end, the tab adjoins the first end with a tab crease to facilitate bending the tab at the first end, such that when the handle is bent to bring the first end to the second end, the first end can be locked to the first end by inserting the tab into the slot from the outer side toward the inner side.

2. The handle as recited in claim 1, wherein each shopping bag has an opening which is one of a shopping bag handle and a handle cutout, further having:

a pair of longitudinal score lines, defining a valley region therebetween wherein the longitudinal score lines facilitate bending the handle, the valley region is extended longitudinally through the shopping bag openings to support the shopping bags;

and a pair of broad surfaces, one of the broad surfaces extending between the hollow region and the first end, the other broad surface extending between the hollow region and the second end, wherein the handle is bent, the broad surfaces are substantially symmetrical about the hollow region, the broad surfaces providing a significant surface area for the user to hold the handle.

3. The handle as recited in claim 2, wherein the tab has a flange and a neck, the neck located at the first end, the flange having a flange width, the slot has a slot width which is slightly less than the flange width, so that when the tab is inserted into the slot, the tab extends fully beyond the slot and the neck becomes trapped therein.

4. The handle as recited in claim 3, wherein the tab has a tab bump, which extends laterally from the tab to increase the thickness of the tab thereat, wherein the slot has a protrusion which acts to narrow the slot thereat, and wherein the tab bump becomes trapped behind the protrusion when the tab is inserted into the slot.

5. The handle as recited in claim 4, wherein the outer side has an advertisement message printed thereon.

6. The handle as recited in claim 4, wherein the outer side has a border, defining a recessed area for accommodating a printed advertisement.

7. A method of carrying shopping bags, the shopping bag having a shopping bag handle, using a handle made of a continuous piece of material having an outer side, an inner side, a first end, a second end, and a valley region therebetween, a tab extending from the first end, and a slot extending fully between the inner side and outer side at the second end, comprising the steps of:

extending the shopping bag handle longitudinally along the valley region, substantially parallel to the first end and the second end;

rolling the handle by bending the handle to bring the first end and second end together, making the inner side concave and the outer side convex; and trapping the shopping bag handle within the valley region by locking the first end and second end together by inserting the tab into the slot from the outer side, through the slot and beyond the inner side.

8. The method of carrying shopping bags, as recited in claim 7, wherein the valley region is defined by a pair of longitudinal score lines, and wherein the step of bending the handle further comprises defining the valley region by bending the handle at the longitudinal score lines.

9. The method of carrying shopping bags, as recited in claim 8, wherein the slot has a slot width and the tab has a flange and a neck, the flange having a flange width which is slightly greater than the slot width, and wherein the step of inserting the tab into the slot further comprises pressing the flange against the slot until the flange extends fully beyond the slot and the neck gets trapped at said slot.

10. The method of carrying shopping bags, as recited in claim 9, wherein the tab has a tab bump which increases the thickness of the tab, and the slot has a protrusion which acts to narrow the slot, and wherein the step of inserting the tab into the slot further comprises forcing the tab bump past the protrusion to trap the tab bump behind the protrusion.

* * * * *